United States Patent [19]

Restall

[11] 4,382,976

[45] May 10, 1983

[54] METHOD OF FORMING CORROSION RESISTANT COATINGS ON METAL ARTICLES

[75] Inventor: James E. Restall, Camberley, England

[73] Assignee: The Secretary of State for Defence in Her Britannic Majesty's Government of the United Kingdom of Great Britain and Northern Ireland, London, England

[21] Appl. No.: 341,258

[22] Filed: Jan. 21, 1982

Related U.S. Application Data

[63] Continuation of Ser. No. 172,972, Jul. 28, 1980, abandoned.

[30] Foreign Application Priority Data

Jul. 30, 1979 [GB] United Kingdom ..... 7926456

[51] Int. Cl.[3] ..... B05D 1/00; B05D 1/08

[52] U.S. Cl. ..... 427/34; 204/164; 427/250; 427/253; 427/405; 427/423

[58] Field of Search ..... 427/252, 250, 253, 34, 427/255, 37, 255.4, 255.7, 405, 404, 423, 422; 204/164

[56] References Cited

U.S. PATENT DOCUMENTS

| | | | |
|---|---|---|---|
| 3,594,219 | 7/1971 | Maxwell et al. | 427/405 |
| 3,873,347 | 3/1975 | Walker et al. | 427/250 |
| 3,977,660 | 8/1976 | Nakahira | 427/405 |
| 3,978,251 | 8/1976 | Stetson et al. | 427/405 |
| 4,101,713 | 7/1978 | Hirsch et al. | 427/405 |
| 4,117,179 | 9/1978 | Jackson et al. | 427/405 |
| 4,145,481 | 3/1979 | Gupta et al. | 427/405 |
| 4,152,223 | 5/1979 | Wallace et al. | 427/405 |
| 4,156,042 | 5/1979 | Hayman et al. | 427/253 |
| 4,163,071 | 7/1979 | Weatherly et al. | 427/34 |

FOREIGN PATENT DOCUMENTS

| | | | |
|---|---|---|---|
| 2829369 | 1/1979 | Fed. Rep. of Germany . | |
| 2399487 | 3/1979 | France . | |
| 2407272 | 5/1979 | France . | |
| 2003935 | 3/1979 | United Kingdom . | |
| 1549845 | 8/1979 | United Kingdom | 427/250 |

*Primary Examiner*—S. L. Childs

*Attorney, Agent, or Firm*—Cushman, Darby & Cushman

[57] ABSTRACT

A metallic or ceramic layer is deposited on a component by plasma spraying. This produces a rough, still porous, coating which is poorly bonded at the interface with the substrate. Aluminium or chromium is vapor deposited under pulsating pressure to react with the substrate to form an oxidation resistant coating of Ni Al (intermetallic) or Ni Cr (solid solution) which may include ceramic particles and is aerodynamically smooth.

6 Claims, No Drawings

METHOD OF FORMING CORROSION RESISTANT COATINGS ON METAL ARTICLES

This is a continuation of application Ser. No. 172,972 filed July 28, 1980, now abandoned.

This invention relates to the coating of metal or other articles with diffusion coatings and more particularly relates to the coating of gas turbine engine components such as turbine blades and inlet guide vanes for improving their high temperature corrosion resistance.

Early heat resistant nickel-base alloys used for turbine blades include a high percentage of chromium (eg 20 wt %) and rely principally on the formation of chromium oxide scale for corrosion resistance. Such alloys have good resistance to both oxidation and sulphidation corrosion.

More recent alloys intended to meet more severe working conditions imposed through higher engine performance and the need for increased service life have changed compositions and their chromium content may be as low as 5%.

The corrosion resistance of alloys of this nature is relatively low and in general it is necessary to resort to protective coatings.

Coatings produced by so-called pack aluminising processes are widely used and, to a lesser extent, coatings produced by the broadly similar chromising and siliconising processes. These coatings have very good oxidation resistance.

Aluminide coatings however tend to be susceptible to sulphidation corrosion attack which is undesirable in gas turbine engines employed in marine environments where sea salt accelerated corrosion can be severe, the processes of degradation by contaminated hot gas streams being numerous and often complicated. Aluminide coatings are also brittle at low temperatures.

All the above processes involve diffusion interaction with substrate alloys and this may detract from the mechanical properties of the latter, in particular by reducing the load-bearing cross-sectional area which can be very significant in the case of thin-wall components such as turbine blades with internal cooling passages, or at leading and trailing edge regions.

Overlay coatings such as may be deposited by physical vapour deposition (pvd) methods, although they require limited diffusion between coating and substrate to facilitate good bonding, do not relay on diffusion interaction for the formation of the coating itself and loss of mechanical properties is minimal. Alloys suitable for use as overlay coatings on nickel-base materials can be produced having very good resistance to sulphidation corrosion. They are moreover more ductile at low temperatures than aluminide coatings.

In their turn, overlay coatings of this nature can have undesirable attributes in the coating structure. Sprayed coatings are known to be porous (as a consequence of shrinking on solidification in the case of plasma sprayed coatings, or due to only partial melting in the case of flame sprayed deposits), they tend to have rough surface finishes which render them unacceptable for aerodynamic reasons for use on turbine blades, and microcracks can develop to run from the outer surface of the coating to the substrate. These features can lead to accelerated corrosion failure of components porosity and surface roughness in particular increase the possibility of entrapment of corrosive debris such as oxides.

The density of such coatings may be improved by very high temperature heat-treatment but this is likely to have an adverse effect on the mechanical properties of the substrate.

The invention is directed to the provision of improved coatings combining the advantages of overlay coatings with those applied by aluminising and the like, by the use of pulse chemical vapour deposition techniques as are disclosed in BP Specification No. 1549845.

According to the invention, a metal or other article is first coated with an overlay by a physical vapour deposition method and is then enclosed in a chamber together with a particulate pack including coating material and a halide activator and cyclically varying the pressure of an inert gas, a reducing gas or a mixture of said gases within the chamber whilst maintaining the contents of the chamber at a temperature sufficient to transfer coating material on to the surface of the overlay to form a diffusion coating therewith. In one embodiment the article is composed of a nickel-base alloy, the overlay is a nickel chrome alloy having a relatively high chromium content, and the coating material is aluminium.

Preferably the overlay is deposited by plasma-arc or flame spraying.

An example of the invention will now be described.

A gas turbine blade fabricated from a nickel-base alloy having the nominal composition Ni-13.5/16% Cr-0.9/1.5% Ti-4.2/48% Al-18/22% Co-4.5/5.5% Mo-0.2. C had an overlay coating of Co Ni Cr Al Y according to the formula Co-25 Cr-12.5 Al-0.35% Y applied by a known plasma arc spraying technique.

In this technique, a dc arc heats a carrier gas (argon) by sustained plasma discharge to produce a high velocity gas stream. The coating material in the form of metal powder is introduced into the arc immediately before a nozzle, the metal particles being melted and then propelled towards the turbine blade. On striking the surface of the blade the molten particles adhere thereto to form an integrally bonded coating having a surface finish of the order of 200–300 micro-inch. Other high temperature, creep resistant, cobalt-, nickel- and iron-base alloy components may be coated in this fashion, while alternative materials for coating include Ni-37Cr-3Ti-2Al, Co Cr Al Y and M Cr Al Y (where M includes Fe, Ni or NiCo). The coating compositions need not include Y or other rare earth elements.

The coated blade was next embedded in a pack comprising a powder mixture of aluminium, $AlF_3$ and $Al_2O_3$. The pack was enclosed in a leak-proof chamber forming part of an electrically heated furnace and which was connected to auxiliary equipment for cyclically varying the pressure in the chamber. The auxiliary equipment comprised a supply of argon, a vacuum pump and a suitable arrangement of valves.

The chamber was next effectively exhausted by the vacuum pump, the temperature of the chamber gas raised to 900° C. and the valves arranged to give a flow of argon into the chamber for 3 seconds, raising the pressure from 6 torr to 28 torr which pressure was maintained for 20 minutes followed by an exhaust period of 7 seconds to restore the lower pressure. The cycle was then repeated and the process continued for 5 hours.

After cooling at removal, the blade was found to be uniformly coated with an aluminised layer. Examination showed that the aluminium had permeated the pores of the overlay and had reacted therewith to form Ni Al and CoAl type intermetallics at the outer interface. The resultant composite coating was substantially impervious, was diffusion bonded to the substrate and aerodynamically smooth. The extent of the diffusion interaction with the substrate alloy was moreover significantly less than where aluminising is carried out directly on to the substrate.

The process can be varied as desired to produce diffusion bonded coatings by chromising, siliconising, boronising etc as set out in BP Specification No. 1549845, the halide activator preferably having a low volatility at coating temperatures as specified therein.

Composite coatings according to the invention are advantageous in that corrosion protection is afforded to areas not normally susceptible to coating by line of sight processes such as plasma spraying, including internal channels and aerofoil/root or aerofoil/shroud platform junctions on gas turbine blades.

Components with aluminised composite coatings as described have been subjected to oxidation conditions for up to 2000 hours at 850° C. without sign of failure and chromised coatings have similarly withstood 2000 hours. Components with aluminised composite coatings have also withstood more than 2000 hours of cyclic oxidation testing to and from 1150° C. and room temperature. Test pieces with chromised composite coatings subjected to salt accelerated corrosion tests have shown no indication of failure after 1200 hours at 750° C. and 500 hours at 850° C.

In all cases, plasma sprayed overlay coatings have failed well before similar ones which have been further treated by pulse cvd or with low pressure chromising.

I claim:

1. A method of forming a corrosion resistant coating on an article composed of a nickel-base alloy, the method comprising the steps of:

(a) coating the article with an overlay comprising M Cr Al Y where M includes Co, Fe, Ni or NiCo by a physical vapor deposition method;

(b) enclosing the article coated according to step (a) in a chamber together with a particulate pack including coating material and a halide activator; and (c) cyclically varying the pressure of an inert gas, a reducing gas, or a mixture of said gases within the chamber while maintaining the contents of the chamber at a temperature sufficient to transfer coating material on to the surface of the overlay to form a diffusion coating therewith.

2. A method according to claim 1 in which the overlay coating in weight percent comprises Co-25Cr-12.5Al-0.35 Y.

3. A method according to claim 1 in which the overlay coating comprises Ni-37Cr-3Ti-2Al.

4. A method of claim 1, claim 2 or claim 3 in which the coating material is chromium, boron or silicon.

5. A method according to claim 1 in which the overlay is deposited by plasma-arc or flame spraying.

6. A method according to claim 1, claim 2 or claim 3 in which the pack comprises a powder mixture of aluminum, $AlF_3$ and $Al_2O_3$.

* * * * *

UNITED STATES PATENT AND TRADEMARK OFFICE

CERTIFICATE OF CORRECTION

PATENT NO. : 4,382,976

DATED : May 10, 1983

INVENTOR(S) : James E. RESTALL

It is certified that error appears in the above—identified patent and that said Letters Patent is hereby corrected as shown below:

Column 1, line 49, change "relay" to --rely--.

Column 2, line 29, change "4.2/48%Al" to --4.2/4.8%Al--.

Column 2, line 61, change "minutes" to --seconds--.

Signed and Sealed this

*Twenty-third* Day of *August 1983*

[SEAL]

*Attest:*

GERALD J. MOSSINGHOFF

*Attesting Officer*

*Commissioner of Patents and Trademarks*